US007118345B2

(12) United States Patent
Wu et al.

(10) Patent No.: US 7,118,345 B2
(45) Date of Patent: Oct. 10, 2006

(54) FAN BLADE

(75) Inventors: Hsiu-Wei Wu, Taipei (TW); Heng-Yi Chen, Chiai (TW); Chin-Fu Lee, Changhua (TW); Wen-Tsao Lee, Hsinchu (TW); Wen-Shi Huang, Jungli (TW); Kuo-Chen Huang, Jhongli (TW); Chieh-Lung Ho, Kaohsiung (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 116 days.

(21) Appl. No.: 10/868,957

(22) Filed: Jun. 17, 2004

(65) Prior Publication Data

US 2005/0002793 A1 Jan. 6, 2005

(30) Foreign Application Priority Data

Jun. 20, 2003 (TW) ..... 92211285 U

(51) Int. Cl.
*F04D 29/30* (2006.01)

(52) U.S. Cl. ..... 416/210 R; 416/243; 416/234

(58) Field of Classification Search ..... 416/243, 416/242, 234, 210 R, 228, 223 R
See application file for complete search history.

(56) References Cited

U.S. PATENT DOCUMENTS

| | | | | |
|---|---|---|---|---|
| 5,527,149 | A * | 6/1996 | Moss et al. | 415/55.1 |
| 6,454,522 | B1 * | 9/2002 | Sakamoto et al. | 415/55.1 |
| 6,579,064 | B1 * | 6/2003 | Hsieh | 416/182 |
| 2002/0114698 | A1 * | 8/2002 | Mimura | 415/220 |

* cited by examiner

*Primary Examiner*—Ninh H. Nguyen
(74) *Attorney, Agent, or Firm*—Birch, Stewart, Kolasch & Birch, LLP

(57) ABSTRACT

An impeller is applied to a centrifugal fan and includes fan blades and a hub. Each fan blade includes a first portion and a second portion. The first portion is located relatively close to the hub and the first portion is coupled to the second portion. The first portion has a windward side and a leeward side, and the windward side is parallel to the leeward side. The second portion is located relatively far away from the hub. The second portion has a windward side and a leeward side, and the windward side and the leeward side are two curved surfaces with different specific curvatures.

18 Claims, 4 Drawing Sheets

FAN BLADE

This Nonprovisional application claims priority under 35 U.S.C. § 119(a) on patent application Ser. No(s). 09/2,211, 285 filed in TAIWAN on Jun. 20, 2003, the entire contents of which are hereby incorporated by reference.

FIELD OF THE INVENTION

The present invention relates to fan blades of an impeller, and more particularly to fan blades of an impeller in a centrifugal blower capable of greatly lowering the noise level.

BACKGROUND OF THE INVENTION

In a conventional system, since its internal electronic element is a large heat source, and the performance of the internal electronic element degrades with the increase of the temperature thereof, the heat generated thereby has to be quickly removed so as to keep the internal electronic element's regular performance. Therefore, a blower having high air pressure is commonly used to achieve the objective of rapidly dissipating heat.

Conventionally, a fan with high air pressure is known as a centrifugal fan or blower. Please refer to both FIG. 1 and FIG. 2, the conventional impeller 100 has a hub 102, fan blades 104 and a rib 106. The rib 106 is disposed and connected between the fan blades 104 and the hub 102. The curvatures of the surfaces 108 and 110 (i.e. a windward side and a leeward side) of the fan blade 104 are the same and can be considered as two concentric arcs, which means the thickness of the fan blade 104 is uniform.

While the performance of an electronic element is enhanced, the heat generated by the electronic element is also greatly increased accordingly. Hence, the rotational speed of the conventional blower used has to be greatly increased so as to obtain the desired air pressure and air flow. However, when the rotational speed is increased, the noise level generated thereby raises correspondingly.

Although the noise level can be reduced by lowering the rotational speed of the conventional blower, the heat generated by the aforementioned electronic element can't be removed completely due to the less air flow and air pressure thereof.

SUMMARY OF THE INVENTION

In view of the foregoing, it is an object of the present invention to provide an impeller applied to a centrifugal blower, so as to greatly lower the noise level while in operation.

The present invention further provides an impeller applied to a centrifugal fan, so as to greatly increase the air pressure in operation.

The present invention further provides an impeller applied to a centrifugal fan, so as to greatly increase the air flow in operation.

As such, the present invention provides an impeller suitable for use in a centrifugal fan, and each fan blade of the impeller includes a first portion and a second portion. The first portion of the fan blade is located relatively close to a hub of the centrifugal fan, and includes a windward side and a leeward side, and the windward side is parallel to the leeward side. The second portion of the fan blade is located relatively far away from the hub and also includes a windward side and a leeward side, and the windward side and the leeward side both are curved surfaces with respective specific curvatures. The first portion of the fan blade is connected with the second portion of the fan blade.

In the aforementioned fan blade structure of the present invention, the thickness of the second portion is greater than that of the first portion. Further, the thickness of the second portion increases gradually along a direction moving away from the hub, and the leeward side of the first portion is tangent to the leeward side of the second portion.

In the aforementioned impeller of the present invention, the impeller further has an annular part and a connection portion disposed between the annular part and the hub for providing an axial airflow. Further, the impeller has a base horizontally extended from the hub, and the first portion and the second portion are vertically extended from the base.

The aforementioned impeller of the present invention also can be used in a blower.

One portion of the fan blade of the impeller of the present invention has a windward side and a leeward side which are parallel to each other, and the other portion of the fan blade has the surfaces tangent to the aforementioned windward side and leeward side, so that the impeller of the present invention can introduce smoother and faster air flow than the conventional technology. Therefore, under the same operation conditions of air pressure and flow, the operation speed of the centrifugal fan with the impeller of the present invention is lower speed than that of the conventional technology, thus greatly lowering the noise level in operation.

The aforementioned fan blade of the impeller in the present invention has a larger windward side, so that, under the same operation condition of rotational speed, the centrifugal fan with the aforementioned impeller can achieve higher air pressure and more air flow than that with the conventional technology.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the following detailed description, and the accompanying drawings, which are given by way of illustration only, and thus are not limitative of the present invention, and wherein.

DETAILED DESCRIPTION OF THE PREFERRED EMBODIMENT

FIRST EXAMPLE

Figure 1:
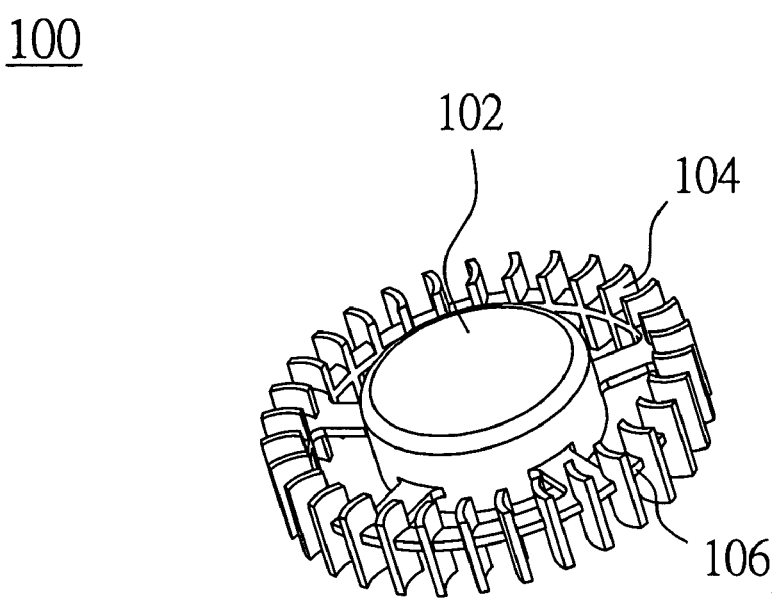
Fig. 1 ( Prior Art )
FIG. 1 is a schematic diagram illustrating a conventional impeller.
Figure 2:
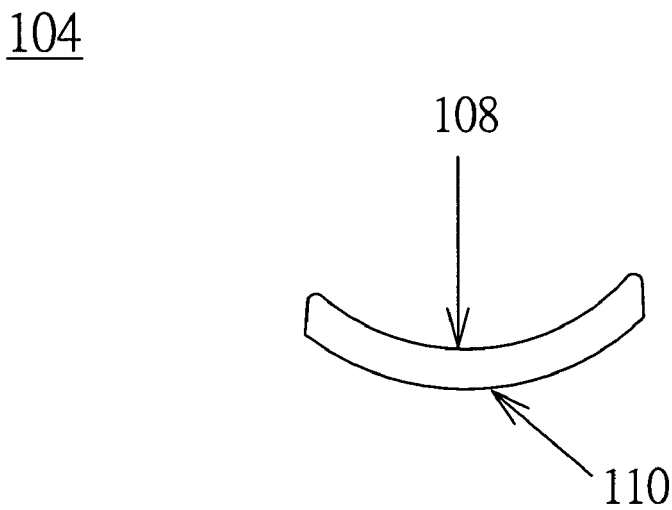
Fig. 2 ( Prior Art )
FIG. 2 is a front view of a fan blade shown in FIG. 1.
Figure 3:
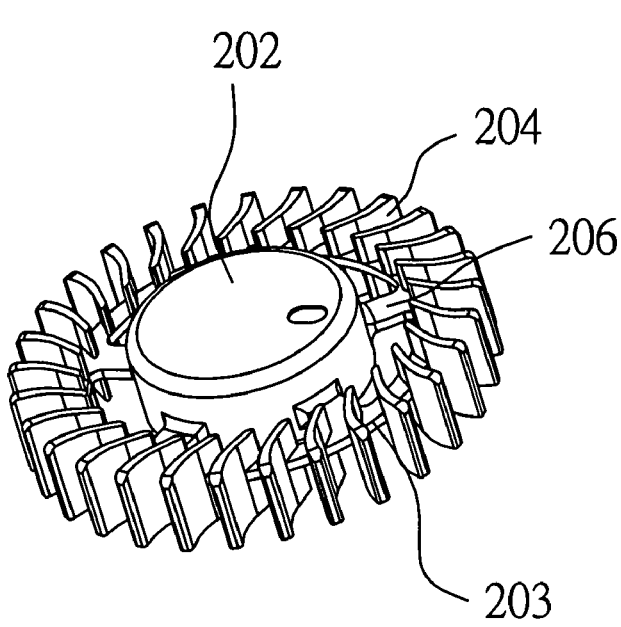
FIG. 3 is a schematic diagram illustrating an impeller according to the first example in the preferred embodiment of the present invention.
Figure 4:
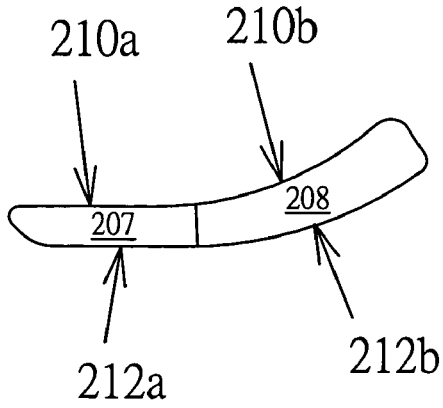
FIG. 4 is a front view of a fan blade shown in FIG. 3.
Figure 5:
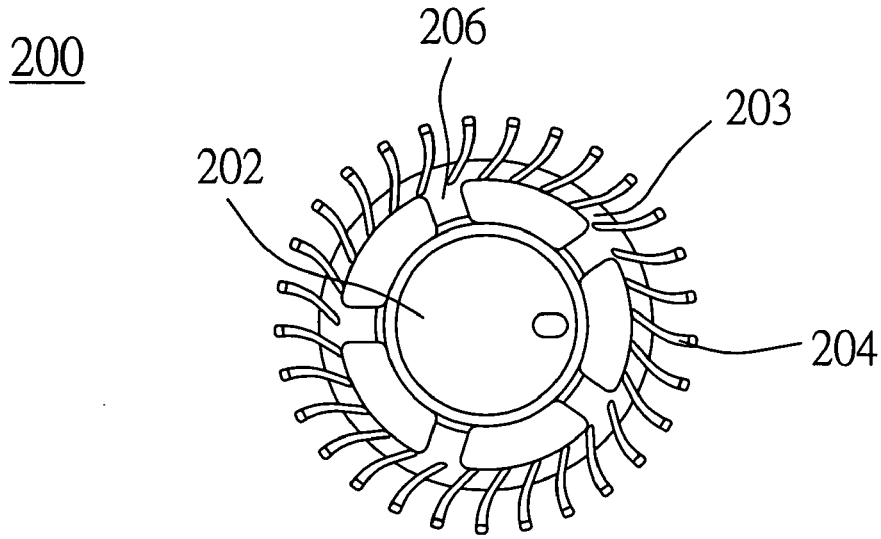
FIG. 5 is a front view of the impeller shown in FIG. 3.

Referring to FIG. 3 to FIG. 5, FIG. 3 is a schematic diagram illustrating an impeller according to the first example in the preferred embodiment of the present invention, FIG. 4 is a front view of a fan blade 204; and FIG. 5 is a front view of the impeller 200. The impeller 200 has a hub 202, an annular part 203, fan blades 204, and a connection portion 206. The fan blades 204 are connected to the hub 202 via the connection portion 206, such as a rib.

The hub 202 includes a motor module used for driving the hub 202 to perform the motion of rotation. The annular part 203 surrounds the hub 202 and the annular part 203 is for disposing the fan blade 204 thereon. The connection portion 206 disposed between the annular part 203 and the hub 202 and the shape of the connection portion 206 can be such as a column shape, a radiation shape, an arc shape, the shape used in an axial-flow fan blade or a streamline shape, etc.

Each of the fan blades 204 is connected to the annular part 203, and is divided into two portions 207 and 208. The portion 207 is located relatively close to the hub 202, and the portion 208 is located relatively far away from the hub 202. The portion 207 is coupled to the portion 208.

The surfaces 210*a* and 212*a* of the portion 207 are considered as the windward and leeward sides of the portion 207 respectively, and the surface 210*a* is parallel to the surface 210*b*. The surfaces 210*b* and 212*b* of the portion 208 are considered as the windward and leeward sides of the portion 208 respectively. The surface 210*b* has a curved surface with a first curvature, the surface 212*b* a curved surface with a second curvature, and the first curvature is different from the second curvature. Further, the surface 210*b* and the surface 212*b* can be considered as two arc-shaped surfaces with the same center, or two arc-shaped surfaces with different centers. Moreover, the surface 210*a* and the surface 212*a* are tangent to the surface 210*b* and the surface 212*b*, respectively.

The portion 207 and the portion 208 are different in thickness, and the thickness of the portion 208 is greater than that of the portion 207. The thickness of the portion 208 gradually increases or decreases along a direction of moving away from the hub 202.

The impeller 200 is applied to various fans, such as a centrifugal fan, blower, axial fan, etc. In the performance analysis of the blower with the impeller 200 of the present invention and the blower with the conventional impeller 100 described above, it is apparently known that, under the same measuring condition for air pressure and air flow, the noise level of the blower with the impeller 200 of the present invention is apparently lower than that of the blower with the conventional impeller 100, because each of the fan blades 204 of the impeller 200 has a larger windward side. As a result, the noise level in the present invention can be greatly reduced by the reduction of rotational speed but the same air pressure and air flow can be obtained.

SECOND EXAMPLE

Figure 6:
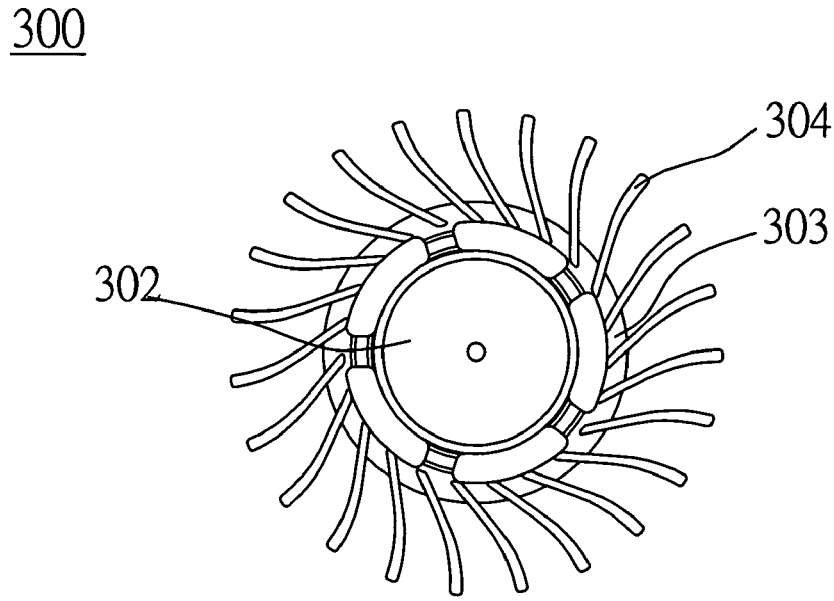
FIG. 6 is a schematic diagram illustrating an impeller according to the second example in the preferred embodiment of the present invention.

Further, referring to FIG. 6, it is a schematic diagram illustrating an impeller 300 according to the second example in the preferred embodiment of the present invention. The difference between the impeller 300 and the aforementioned impeller 200 is that each of the fan blades 304 of the impeller 300 has a larger windward area than each of the fan blades 204 of the impeller 200. In this case, the end of each fan blade 304 on an annular part 303 can be at the location closer to the hub 302, so that greater air pressure, air flow and the better visual effect are obtained when the impeller 300 is applied to a centrifugal fan or a blower.

THIRD EXAMPLE

Figure 7:
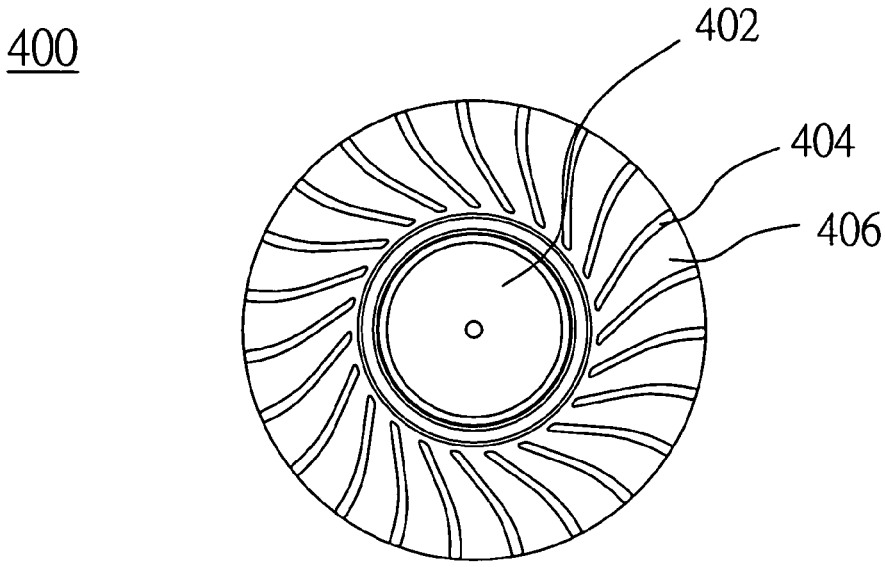
FIG. 7 is a schematic diagram illustrating an impeller according to the third example in the preferred embodiment of the present invention.

Referring to FIG. 7, it is a schematic diagram illustrating an impeller 400 according to the third example in the preferred embodiment of the present invention. The difference between the impeller 400 and the aforementioned impeller 200 is that the impeller 400 further includes a base 406 located around the hub 402 and horizontally extended from the hub 402, and each of the fan blades 404 of the impeller 400 is vertically extended from the base 406 and on the base 406, or the fan blades 404 can be both vertically extended from the base 406 toward up and down, and the base 406 is considered as horizontally being in the middle of each fan blade 404. As to this type of impeller 400, the hub 402, the base 406 and the fan blades 404 can be integrally formed so as to reduce the process steps and thus shortening process time.

FOURTH EXAMPLE

Figure 8:
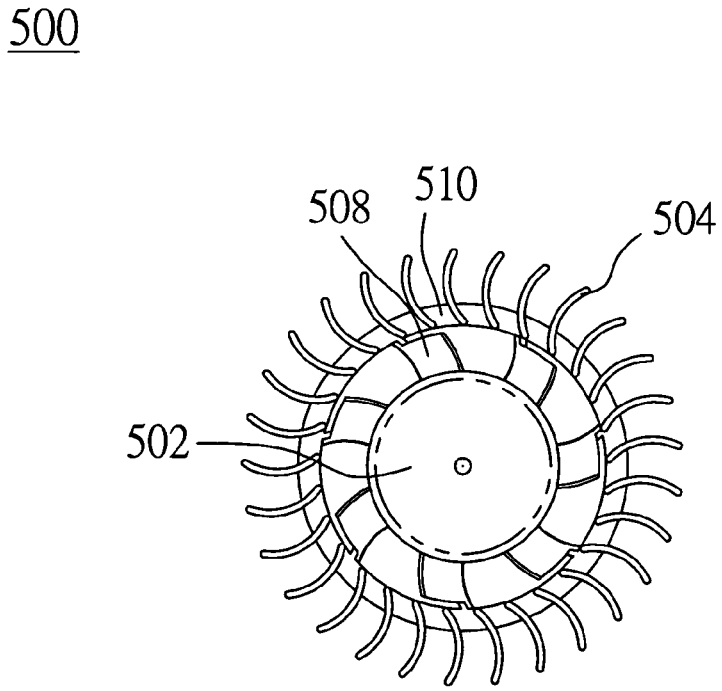
FIG. 8 is a schematic diagram illustrating an impeller according to the fourth example in the preferred embodiment of the present invention.

Referring to FIG. 8, it is a schematic diagram illustrating an impeller 500 according to the fourth example in the preferred embodiment of the present invention. The difference between the impeller 500 and the aforementioned impeller 200 is that the connection portion 508 disposed between the annular part 510 and the hub 502 for providing an axial airflow and the shape of the connection portion 508 has a shape used in an axial-flow fan blade. Because the connection portion 508 has a shape like axial-flow fan blade, heat dissipation of a blower with the impeller 500 can be improved via the function of directing airflow by the connection portion 508 of the axial-flow type when the blower with the impeller 500 is in operation.

The present invention uses the fan blade of which the thickness increases gradually along the direction moving away from the hub as the example for explanation. However, the present invention is not limited thereto. The thickness of the fan blade of the present invention also can be decreased gradually along the direction moving away from the hub.

To sum up, the fan blade of the present invention, including a first portion that has a windward side and a leeward side which are parallel to each other, and a second portion that has varied thickness, can guide and direct air flow with fluency so that a slower rotational speed is enough to provide required air pressure and air flow. As a result, the noise level in operation can be greatly lowered.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A fan blade, applied to an impeller having a hub, comprising:

a first portion, located relatively close to the hub and having a first windward side and a first leeward side, wherein the first windward side is parallel to the first leeward side; and a second portion, located relatively far away from the hub;

wherein the first portion is coupled to the second portion, and thickness of the second portion gradually increases or decreases along a direction of moving away from the hub;

wherein the impeller further has an annular part for disposing the fan blade thereon, and a rib disposed and connected between the annular part and the hub.

2. The fan blade of claim 1, wherein the second portion has a second windward side and a second leeward side, the second windward side has a curved surface with a first curvature, and the second leeward side has a curved surface with a second curvature.

3. The fan blade of claim 2, wherein the first curvature is different from the second curvature.

4. The fan blade of claim 3, wherein the first windward side is tangent to the second windward side.

5. The fan blade of claim 3, wherein the first leeward side is tangent to the second leeward side.

6. The fan blade of claim 1, wherein the impeller further has a connection portion disposed between the annular part and the hub for providing an axial airflow.

7. The fan blade of claim 1, wherein the impeller further has a base horizontally extended from the hub, wherein the first portion and the second portion are vertically extended from the base.

8. An impeller, comprising:

a hub; and a plurality of fan blades disposed around the hub, each of which has a first portion located relatively close to the hub and having a first windward side and a first leeward side, wherein the first windward side is parallel to the first leeward side, and a second portion, located relatively far away from the hub, coupled to the first portion and having a second windward side and a second leeward side;

an annular part for disposing the fan blade thereon; and a connection portion disposed between the annular part and the hub.

9. The impeller of claim 8, wherein the second portion has a second windward side and a second leeward side, the second windward side has a curved surface with a first curvature, and the second leeward side has a curved surface with a second curvature.

10. The impeller of claim 9, wherein the first curvature is different from the second curvature.

11. The impeller of claim 8, wherein thickness of the second portion gradually increases along a direction of moving away from the hub.

12. The impeller of claim 8, wherein thickness of the second portion gradually decreases along a direction of moving away from the hub.

13. The impeller of claim 8, wherein the first windward side is tangent to the second windward side.

14. The impeller of claim 8, wherein the first leeward side is tangent to the second leeward side.

15. The impeller of claim 8, further comprising a rib disposed and connected between the annular part and the hub.

16. The impeller of claim 8, wherein the connection portion is disposed and connected between the annular part and the hub for providing an axial airflow.

17. The impeller of claim 8, further comprising a base horizontally extended from the hub, wherein the first portion and the second portion are vertically extended from the base.

18. An impeller, comprising:

a hub; and a plurality of fan blades disposed around the hub, each of which has a first portion located relatively close to the hub and having a first windward side and a first leeward side, wherein the first windward side is parallel to the first leeward side, and a second portion, located relatively far away from the hub, coupled to the first portion and having a second windward side and a second leeward side; and a base horizontally extended from the hub, wherein the first portion and the second portion are vertically extended from the base.

* * * * *